United States Patent [19]

Laiquddin et al.

[11] Patent Number: 4,579,523

[45] Date of Patent: Apr. 1, 1986

[54] METHOD OF OPERATING A CONTROLLED ATMOSPHERE FURNACE

[75] Inventors: Sahibzada S. Laiquddin, Dorsten; Günter Stemmer, Essen, both of Fed. Rep. of Germany

[73] Assignee: Ruhrgas Aktiengesellschaft, Essen, Fed. Rep. of Germany

[21] Appl. No.: 720,053

[22] Filed: Apr. 5, 1985

Related U.S. Application Data

[63] Continuation of Ser. No. 582,939, Feb. 23, 1984, abandoned.

[30] Foreign Application Priority Data

Feb. 26, 1983 [DE] Fed. Rep. of Germany ..... 3306911

[51] Int. Cl.[4] ..... C21D 1/06; F27B 9/02

[52] U.S. Cl. ..... 432/2; 432/5; 432/6; 432/18; 432/23; 432/253; 414/186; 414/292

[58] Field of Search ..... 432/253, 2, 3, 5, 6, 432/18, 23; 414/186, 292

[56] References Cited

U.S. PATENT DOCUMENTS

| | | | |
|---|---|---|---|
| 3,063,878 | 11/1962 | Wilson | 432/18 |
| 3,107,825 | 10/1963 | Reed | 414/292 |
| 3,197,184 | 7/1965 | Navez et al. | 432/18 |
| 3,447,788 | 6/1969 | Bornor | 432/2 |
| 3,722,715 | 3/1973 | Young | 414/292 |
| 3,778,221 | 12/1973 | Bloom | 432/18 |
| 3,852,026 | 12/1974 | Johansson | 432/23 |
| 3,907,123 | 9/1975 | Howell | 414/186 |
| 4,129,090 | 12/1978 | Inaniwa et al. | 432/253 |
| 4,238,122 | 12/1980 | Snyder et al. | 432/23 |
| 4,439,146 | 3/1984 | Sugita | 432/6 |

*Primary Examiner*—Henry C. Yuen

*Attorney, Agent, or Firm*—Becker & Becker, Inc.

[57] ABSTRACT

A method of operating a controlled atmosphere furnace. To prevent the entry of oxygen into the controlled atmosphere in the chamber of the furnace, which has a furnace door for the receipt and removal of parts by means of a feeding and removal device, the device is designed to seal a vestibule located immediately in front of the furnace door when the device approaches the furnace door. The oxygen-containing ambient air thus trapped in the vestibule is then removed therefrom. The furnace door is opened, and the feeding and removal device, while still sealing the vestibule from the ambient air, then moves into the furnace chamber for feeding or removing the part which is to be heat treated.

1 Claim, 1 Drawing Figure

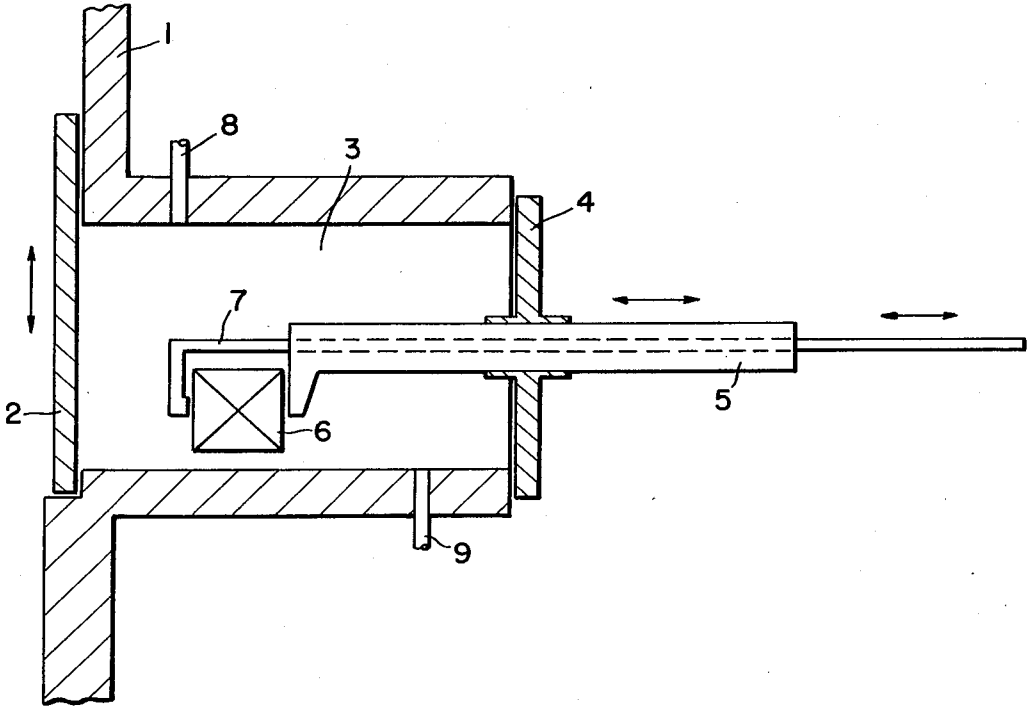
1
2
3
4
5
6
7
8
9

METHOD OF OPERATING A CONTROLLED ATMOSPHERE FURNACE

This application is a continuation of application Ser. No. 582,939-Laiquddin et al, filed Feb. 23, 1984, now abandoned.

BACKGROUND OF THE INVENTION

The present invention relates to a method of operating a rotary or similar furnace which contains a controlled atmosphere and is equipped with a furnace door through which the parts being treated under said controlled atmosphere are fed into and removed from the furnace chamber, which contains said controlled atmosphere, by means of a feeding and removal device.

It is well known that rotary or other furnaces for heat treating turbine blades or other materials must have a controlled atmosphere. Conventional rotary furnaces are only equipped with one opening for charging or feeding the parts to be treated into, and removing the parts having been treated from, the controlled atmosphere furnace chamber, said opening being closed by a furnace door during the heat treating process. Because of the relatively large size that any such furnace opening for feeding and removing parts to be treated must have, oxygen from the ambient air will enter and mix with the furnace atmosphere when the furnace door is opened, unless complex precautions are taken. Even a furnace vestibule located immediately in front of the furnace door and fitted with a vestibule entry door would not adequately prevent any such entry of oxygen into the furnace chamber, because the feeding and removal device which carries the part to be heat treated or having been heat treated would have to move through the open vestibule door and the open furnace door for feeding said part for treatment or removing said part after treatment, thus at the same time allowing ambient air to enter the controlled furnace atmosphere. If such a furnace were protected by flushing controlled atmosphere from the furnace chamber into any such vestibule to prevent the entry of oxygen while the furnace door and the vestibule entry door are open, the quantity of controlled atmosphere, needed for the protection of the furnace atmosphere by the technique described, would be too high for a cost efficient or economical heat treatment.

It is therefore an object of the present invention to provide a comparatively simple method of reliably preventing the entry of oxygen into the controlled atmosphere in the furnace chamber of a rotary or similar furnace of the aforementioned general type without increasing the volume of controlled atmosphere required for the operation of such a furnace beyond the limits set by a cost efficient and economical heat treatment.

BRIEF DESCRIPTION OF THE DRAWING

This object, and other objects and advantages of the present invention, will appear more clearly from the following specification in conjunction with the accompanying drawing, which shows one possible exemplary embodiment of an arrangement for carrying out the inventive method.

SUMMARY OF THE INVENTION

The method of the present invention is characterized primarily in that: the device used for feeding the parts into, and removing the parts from, the furnace chamber seals the entry of a vestibule located immediately in front of the furnace door while approaching the closed furnace door; in that the oxygen-containing ambient air trapped in said vestibule is thereafter removed from said vestibule; and in that said device then enters the furnace chamber, the furnace door having been opened, while still sealing the vestibule entry. The device used for furnace feeding and removal is fitted with an appropriate sealing means, and is simultaneously used for locking and sealing the entry to the vestibule in front of the furnace door. The method described thereby provides, during approach of the feeding and removal device, a tight vestibule sealed by the seal on the device; the oxygen-containing ambient air trapped in the vestibule is then removed, preferably by cycling controlled atmosphere from the furnace chamber through the vestibule for purging, to reduce the oxygen level in the vestibule sufficiently to prevent the entry of oxygen, or a detrimental quantity of oxygen, into the furnace chamber while the furnace door is opened to allow the feeding and removal device to enter. In one embodiment of the present invention, the seal of the feeding and removal device referred to above can take the form of a cap or cover which seals the vestibule inlet; the arm of the feeding and removal device, along with the part for heat treatment carried thereby, is pushed forward through said seal, without disturbing the latter, and through the open furnace door into the furnace chamber following the removal of the oxygen-containing ambient air from the vestibule. In another embodiment of the present invention, the seal may take the form of a piston with the atmosphere, contained in the vestibule following an adequate reduction of the oxygen level, being displaced through vents by the seal entering the vestibule, and the arm of the feeding and removal device moving forward through the open furnace door into the furnace chamber.

DESCRIPTION OF A SPECIFIC EMBODIMENT FOR PRACTICING THE INVENTION

Referring now to the drawing in detail, the sole FIGURE illustrates by way of example one embodiment for carrying out the inventive method. The furnace 1, which is only partially shown, is provided with a furnace door 2 by means of which the furnace chamber (not shown in detail) can be closed off. Directly in front of the furnace door 2 is a vestibule 3, which can be closed off, e.g. in the manner of a cover, by the sealing means 4 of the feeding and removal device 5, which itself is sealingly yet movingly disposed in the sealing means 4. By means of the movable device 5, the piece which is to be heat treated can be fed or introduced into the furnace chamber when the door 2 is opened, and can again be removed from the furnace after heat treatment is complete.

The part 7 of the device 5 can be shifted relative to the latter to adapt to the size of the piece 6, which is held by the device 5 and the part 7 thereof in a clamp-like manner.

The vestibule 3 is further provided with a supply conduit 8 for delivering to the vestibule 3, in its closed state, controlled atmosphere for purging the vestibule 3 of oxygen-containing atmosphere which was able to enter when the vestibule was open for placement of the piece 6 therein. This oxygen-containing atmosphere is forced out through a discharge conduit 9, at least to such an extent that the oxygen content of the atmosphere in the vestibule 3 is reduced to a desirable level.

The present invention is, of course, in no way restricted to the specific disclosure of the specification and drawing, but also encompasses any modifications within the scope of the appended claim.

What we claim is:

1. In a method of operating a rotary furnace having a furnace chamber in which parts can be heat treated in a controlled atmosphere; said furnace chamber being provided with a furnace door through which said parts can be fed into and removed from said furnace chamber; said furnace also having a vestibule immediately in front of said furnace door, said vestibule having an entry remote from said furnace door; and also having a feeding and removal device therewith for effecting said feeding and removal of said ports through said entry via said vestibule through said furnace door into and out of said furnace chamber as well as having a sealing element arranged directly as a component of and carried by said feeding and removal device itself; said method having improvement in combination therewith comprising the steps of:

closing said furnace door;

sealing said entry of said vestibule gas tight with said sealing element carried by said feeding and removal device itself while moving the latter in said vestibule in the direction toward said closed furnace door subject to oxygen-containing ambient air being trapped in said vestibule;

then removing from said vestibule the foregoing oxygen-containing ambient air trapped in said vestibule during the preceding step;

thereafter opening said furnace door; and thereupon finally introducing said feeding and removal device into said furnace chamber, through said opened door, while maintaining said gas tight sealing of said entry of said vestibule via said sealing element arranged directly as a component of said feeding and removal device itself during introduction of said parts being fed thereto respectively during removal of parts therefrom so that manipulating and handling of the parts in the furnace is possible while securely maintaining said gas tight sealing of said entry of said vestibule as well as thereby at the same time maintaining the controlled atmosphere so that parts can be heat treated in the furnace chamber.

* * * * *